US008980021B2

(12) United States Patent
Doty et al.

(10) Patent No.: US 8,980,021 B2
(45) Date of Patent: Mar. 17, 2015

(54) METAL TREATMENT TO ELIMINATE HOT TEAR DEFECTS IN LOW SILICON ALUMINUM ALLOYS

(75) Inventors: Herbert W. Doty, Amherst, NH (US); Fawzy H Samuel, Chicoutimi (CA); Ahmed M Nabawy, Chicoutimi (CA)

(73) Assignee: GM Global Technology Operations LLC, Detroit, MI (US)

( * ) Notice: Subject to any disclaimer, the term of this patent is extended or adjusted under 35 U.S.C. 154(b) by 526 days.

(21) Appl. No.: 12/060,990

(22) Filed: Apr. 2, 2008

(65) Prior Publication Data

US 2009/0252643 A1 Oct. 8, 2009

(51) Int. Cl.
*B22D 27/20* (2006.01)
*B22D 21/04* (2006.01)
*C22C 21/16* (2006.01)

(52) U.S. Cl.
CPC ..... *B22D 27/20* (2013.01); *B22D 21/04* (2013.01); *C22C 21/16* (2013.01)
USPC ..... 148/549

(58) Field of Classification Search
CPC ..... B22D 21/04; B22D 27/20
USPC ..... 148/538, 549–552, 437–440; 420/528–535, 537–544, 546–547, 420/550–553
See application file for complete search history.

(56) References Cited

U.S. PATENT DOCUMENTS 5,376,192 A 12/1994 Cassada, III
6,551,424 B1 4/2003 Haszler et al.
6,562,154 B1 5/2003 Rioja et al.
6,645,321 B2 11/2003 Sigworth
6,921,512 B2 7/2005 Doty
2005/0199318 A1* 9/2005 Doty ..... 148/439
2008/0060723 A1 3/2008 Doty

FOREIGN PATENT DOCUMENTS

DE 60102870 T2 3/2005
DE 102005010626 A1 10/2005
DE 102007042099 A1 3/2008
WO 2006019946 A2 2/2006

OTHER PUBLICATIONS

David V. Neff, "Grain Refining of Aluminum Alloys" in "Nonferrous Molten Metal Processes." ASM Handbook, vol. 15. 2002.*

* cited by examiner

*Primary Examiner* — Brian Walck
(74) *Attorney, Agent, or Firm* — Dinsmore & Shohl LLP

(57) ABSTRACT

An aluminum alloy and a method of casting. At least one of zirconium, scandium, a nucleating agent selected from the group consisting of metal carbides, aluminides and borides, and rare earth elements are added to the alloy while in the molten state such that upon solidification, the cast alloy exhibits improved hot tear resistance. In a particular form, the nucleating agent may be titanium diboride for grain refining. Other agents that can be used for grain refining include scandium, zirconium, silicon, silver and one or more rare earth elements. In the case of rare earth elements, mischmetal may be used as a precursor. Combinations of titanium diboride and at least one other agent are especially effective in reducing the incidence of hot tearing in products cast from the modified aluminum alloy.

15 Claims, 9 Drawing Sheets

METAL TREATMENT TO ELIMINATE HOT TEAR DEFECTS IN LOW SILICON ALUMINUM ALLOYS

BACKGROUND OF THE INVENTION

The present invention relates generally to improved high strength aluminum base alloys having improved hot tear resistance when solidified into cast products.

It is well-known that alloying ingredients improve the properties of an aluminum-based material. High-strength aluminum alloys (which typically contain less than ninety five percent by weight aluminum, and possess a heat-treated yield strength in excess of approximately thirty thousand pounds per square inch) can be made compatible with low-cost fabrication techniques such as casting. For example, the addition of silicon (Si) to aluminum results in an improved ability of the molten metal to flow, thereby improving castability. Other alloying agents, such as copper, can be used to improve the strength characteristics of aluminum-based alloys, although traditionally at the expense of castability. Others may include both.

One such alloy, created by the Assignee of the present invention, is known as GM220, an alloy that can be easily cast into engine blocks, heads and other components for high-strength, weight-sensitive applications. Nevertheless, many aluminum alloys such as GM220 are not able to fully realize the efficient, low cost manufacturing that casting has to offer because of the tendency to form a defect known as hot tearing. In hot tearing, the strength of the solidifying melt is insufficient to withstand the stress related to thermal contraction of the metal due to solidification shrinkage and thermal expansion. Such phenomenon is exacerbated when the mold is more rigid, such as in metal molds.

Modified fabrication techniques, such as mold thermal control and higher pouring temperatures, can be used to reduce this problem; however, such approaches are often limited by the geometry of the molded part, as well as the complexity and concomitant expense. Likewise, casting simple billets with extensive post-cast machining significantly increase the cost, and therefore defeat the purpose of low-cost casting operations.

Grain refining is a preferred way to reduce the likelihood of hot tearing in castable aluminum alloys. In grain refining, a master alloy (for example, a titanium (Ti)-containing or related agent) is added to the molten metal just prior to pouring. In one well-known form, such master alloy may be a metal carbides, nitride and boride, such as titanium diboride ($TiB_2$). It is believed that these master alloys introduce microscopic particles as nucleating agents into the melt.

Despite the addition of such master alloys, it is still desirable that an improved method of grain refinement of high strength, aluminum-based casting alloys be developed. It is further desirable that such grain refinement be useful in the production of an aluminum-based alloy without the attendant problem of hot tearing.

BRIEF SUMMARY OF THE INVENTION

These desires are met by the present invention, wherein an improved high strength aluminum alloy substantially free from hot tearing is disclosed. By the disclosed invention, hot tear-inhibiting materials are introduced into an aluminum alloy such that smaller grain sized cast parts are produced. In accordance with a first aspect of the present invention, a method of increasing hot tear resistance in a cast aluminum alloy is disclosed by providing one or more of Si, copper (Cu), zinc (Zn), magnesium (Mg), iron (Fe), manganese (Mn) and strontium (Sr) as alloying ingredients to an aluminum-based mixture, adding at least one grain refining agent to the mixture, forming the mixture and the grain refining agent into a castable melt, casting the melt into a mold; and solidifying the melt in the mold to provide a substantially hot tear-free cast aluminum alloy product. The grain refining agent includes one or more of scandium (Sc), zirconium (Zr), metal carbides, metal aluminides, metal borides and at least one rare earth element. It will be understood by those skilled in the art that trace quantities of impurities, such as calcium (Ca) and phosphorous (P), may also be present in the alloy.

Optionally, particular concentrations of the grain refining agents are used. In one form, the Sc is included in an amount of up to 0.15 weight percent of the mixture. Likewise Zr can be used, either with or in place of the Sc. Concentrations may include up to 0.7 weight percent of the mixture, with more particular levels being 0.5 weight percent, 0.3 weight percent and 0.15 weight percent. Of the metal borides, carbides and nitrides, the present inventors have found that $TiB_2$ is a particularly suitable grain refining agent, preferably in conjunction with one or both of the Sc or Zr. Silver (Ag), in an amount of up to 0.7 weight percent of the mixture, may also be included. In one particular form, Ag can be added with the $TiB_2$, Zr and an optional amount of Sr. In a particular form, the grain refining agent further comprises $TiB_2$ and Ag. Instead of, or in addition to, the Sc, Zr and $TiB_2$, up to approximately 1.5 weight percent of at least one rare earth element can be added to the mixture. In the present context, the terms "approximately" and its variants, Likewise, the term "about" is construed in the present context to be equivalent to "approximately" or "nearly". In this way, limits that use such modifiers indicate that exactitude is not claimed, but rather a contemplated variation between chemically desirable lower and upper operative limits.

The rare earth element or elements may be produced from mischmetal that is added to the mixture. In one particular form, the aluminum alloy is a high-strength, low-silicon alloy, comprising no more than about 2.0 weight percent Si. In a more particular variant, there is no more than about 1.0 weight percent Si. The metal carbide, metal aluminide and metal boride preferably include a titanium-containing compound that produces between about 0.02 and about 0.2 weight percent of Ti in the mixture. As stated above, such Ti can be in the form of $TiB_2$. While the present method may be applied to numerous casting operations, the present inventors have found it to be particularly well-suited to permanent mold casting.

Various ranges may be used, depending on the particulars of the alloy. For example, a silicon content of up to about 1.3 weight percent Si may include a narrower range of between about 1.1 and about 1.3 weight percent (in the case of GM220), and about 0.1 weight percent (in the case of Alloy 206). Likewise, the range of between about 0.1 and about 0.5 percent Fe is between about 0.4 and about 0.5 percent iron (in the case of GM220), and about 0.1 percent (in the case of Alloy 206). Similarly, the Cu content is between about 1.9 and about 2.5 weight percent (in the case of GM220), and about 4.2 and 5.0 weight percent (in the case of Alloy 206). Mn is present in an amount between about 0.5 and about 0.75 weight percent (in the case of GM220, with a particularly useful upper limit of about 0.73 weight percent), and between about 0.2 and about 0.5 weight percent (in the case of Alloy 206). Mg is present in an amount between about 0.3 and about 0.5 weight percent (in the case of GM220), and between about 0.2 and about 0.35 weight percent (in the case of Alloy 206). Up to about 0.04 weight percent Ca and about 0.04 weight percent P is present (in the case of GM220. The other alloying ingredients that make up to about 0.05 weight percent of either GM220 or Alloy 206 may include nickel (Ni), tin (Sn), Ti alone or in combination.

According to another aspect of the invention, a method of improving hot tear resistance in an aluminum alloy is disclosed. The method includes adding $TiB_2$ in addition to at least one grain refining agent to an aluminum-based mixture that comprises Si, Cu, Mg, Fe and Mn. The additional grain refining agent may include Sc, Zr and at least one rare earth element. The method further includes forming the mixture with the $TiB_2$ and the grain refining agent (or agents) into a castable melt, placing the melt into a mold and solidifying the melt in the mold. In another form, elemental boron can be added to a titanium-containing melt to form the $TiB_2$.

According to yet another aspect of the invention, an aluminum alloy is disclosed. The alloy includes up to about 2.0 weight percent Si, between about 1.9 and about 5.0 weight percent Cu, between about 0.2 and about 0.5 weight percent Mg, between about 0.1 and about 0.5 weight percent Fe, between about 0.2 and about 0.75 weight percent Mn such that a weight ratio of Mn to Fe is between about 1.25 and about 1.45, between about 0.02 and about 0.2 weight percent Ti, up to 0.01 weight percent Sr, up to 0.05 weight percent Zn, up to 0.05 weight percent Ca, up to 0.05 weight percent P, one or more grain refining agents from the group selected from Sc, Zr, rare earth element and $TiB_2$, and a balance substantially made up of aluminum. In an optional form, the Sc, if present, is in a concentration of up to about 0.15 weight percent of the alloy. Likewise, the Zr, if present, is in a concentration of up to about 0.7 weight percent of the alloy. Lastly, the rare earth element, if present, is in a concentration of up to about 1.5 weight percent of the alloy.

BRIEF DESCRIPTION OF THE SEVERAL VIEWS OF THE DRAWINGS

The following detailed description of the present invention can be best understood when read in conjunction with the following drawings, where like structure is indicated with like reference numerals and in which.

DETAILED DESCRIPTION OF THE PREFERRED EMBODIMENTS

Figure 1A:
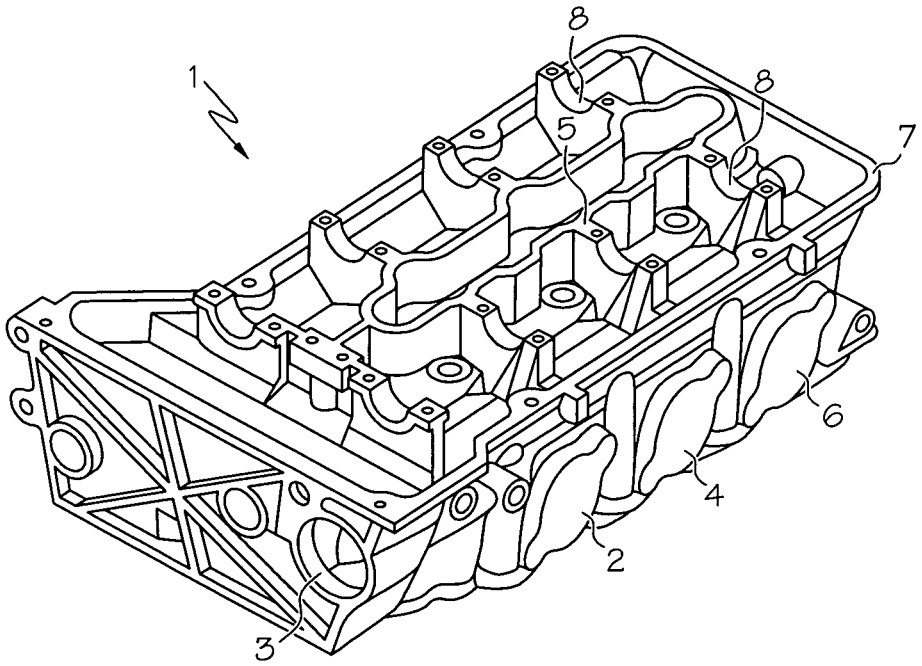
FIG. 1A shows an automotive cylinder head made according to an aspect of the present invention.
Figure 1B:
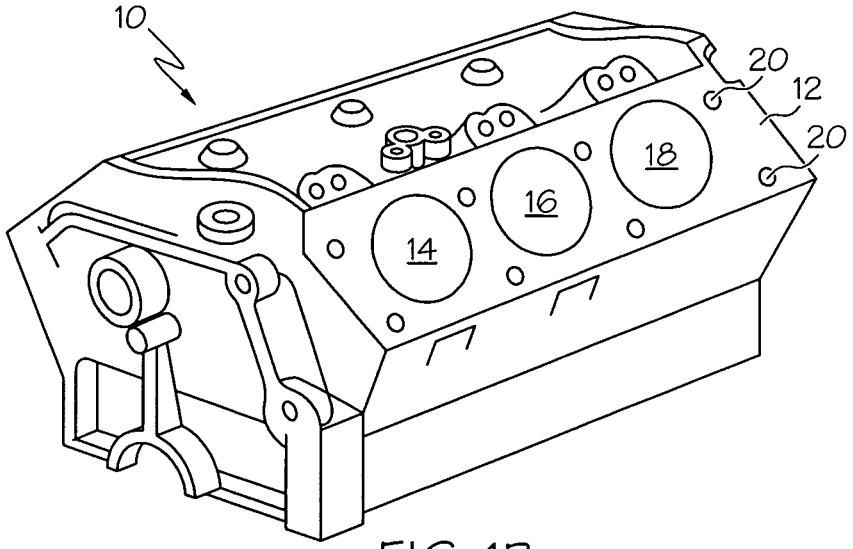
FIG. 1B shows an automotive cylinder block that could also be made according to an aspect of the present invention.

Referring initially to FIGS. 1A and 1B, a cylinder head 1 and a cylinder block 10 for an automotive engine made from the GM220 aluminum alloy is shown. Such devices can be made by casting techniques known to those skilled in the art. For example, cylinder head 1 and block 10 can be made through permanent mold casting. As shown, both the cylinder head 1 and block 10 are cast in the well-known V-6 configuration, although it will be appreciated that other engine configurations are equally applicable. Referring with particularity to FIG. 1A, cylinder head 1 includes intake ports 2, 4 and 6, as well as corresponding exhaust ports (not shown) on the opposite side. Additional components include a timing chain cover 3, spark plug tower 5, valve cover rail 7 and cam carriers 8. Referring with particularity to FIG. 1B, block 10 is secured to the cylinder head 1 of FIG. 1A (such as by bolting). One bank 12 of the block 10 includes three of the cylinders 14, 16 and 18 formed therein. Bolt holes 20 for fastening the cylinder heads 1 to the cylinder block 10 are typically machined in, such as by drilling and threading. Other surfaces may also be machined as well. Specifically, the region between the openings for the exhaust valves (not shown) on cylinder head 1 operate at very high temperatures and are therefore subject to high stresses due to the thermal expansion of the constrained part. Cycling between operating temperature and non-operating temperature imparts thermal fatigue on these regions of the cylinder head 1. The relatively high strength and elongation and the absence of a silicon eutectic phase provide excellent resistance to thermal fatigue. The relatively high ratio of Mn to Fe of alloys such as GM220 provide improved machinability and lower levels of casting porosity. Nevertheless, the bulk of the operation is the initial casting, while various alloying agents (for example, the aforementioned Mn) are included to facilitate post-casting machinability.

In one form, the alloy is made up of between 1.0 and 2.0 weight percent silicon (Si) with a particularly beneficial upper range of about 1.3 weight percent, 1.9 and 3.5 weight percent Cu, 0.3 and 0.5 weight percent Mg, 0.4 and 0.5 weight percent Fe, 0.5 and 0.73 weight percent Mn, 0.02 to 0.2 weight percent Ti, up to 0.05 weight percent Sr, up to 0.5 weight percent Zn, up to 0.04 weight percent Ca, up to 0.04 weight percent P, (all numbers approximate) and a balance of aluminum and minute quantities of incidental impurities. In addition, a preferred (but not required) ratio of Mn to Fe is between approximately 1.25 and 1.45.

GM220 includes enough Si (between approximately one and two percent by weight) to form intermetallic compounds, but not so much as to form a separate eutectic Si phase that if present would undesirably lead to hot spots, as well as decrease the overall thermal conductivity and mechanical properties of the casting. The inclusion of such Si quantities can be beneficial in improving thermal fatigue resistance. Likewise, the inclusion of Cu helps to strengthen the alloy. For these reasons, GM220 exhibits high strength (tensile strengths of between approximately 250 and 400 MPa, depending on the casting technique), good elongation (between approximately 0.5 and 4.5 percent, again, depending on the casting technique) and low microporosity. The alloy includes Cu for its ability to increase strength and other mechanical properties, although such level is kept relatively low to avoid reductions in corrosion resistance. Mn is included to control the grain structure, while Zn improves the precipitation hardening response and corrosion performance, as long as levels aren't so high that they harm welding performance.

GM220 is also easy to cast, and is amenable to multi-step heat treating that can allow tailoring of the desired strength levels. These attributes make it useful in the production of high quality automotive castings. For example, higher strength alloys allow for the formation of components that can be made lighter for the same load bearing properties so that increased specific properties (an important consideration for automotive, aeronautical and other transportation applications) can be realized.

Figure 2:
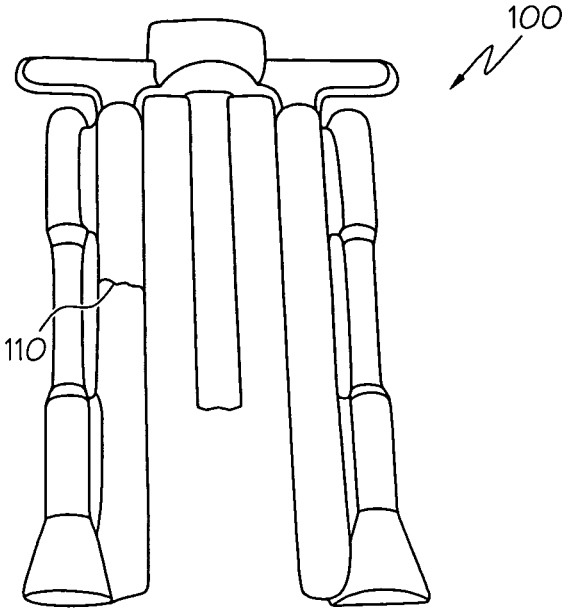
FIG. 2 shows a typical hot tear formed in a casting made from an aluminum alloy of the prior art.
Figure 9A:
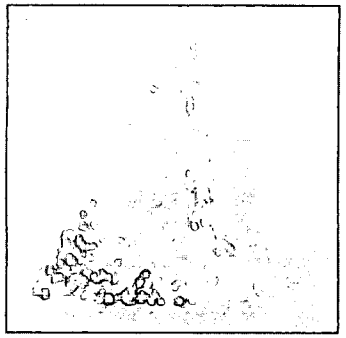
FIGS. 9A through 9E show the different levels of crack severity in various test bars made up of a typical cast aluminum-based alloy, such as Alloy 206.
Figure 9B:
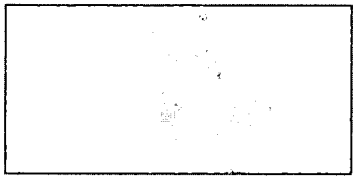
Figure 9C:
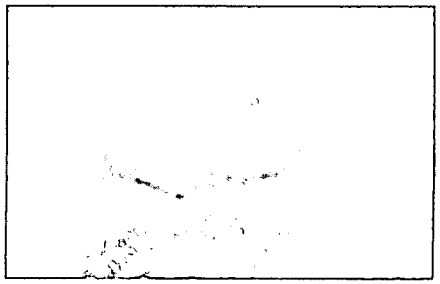
Figure 9D:
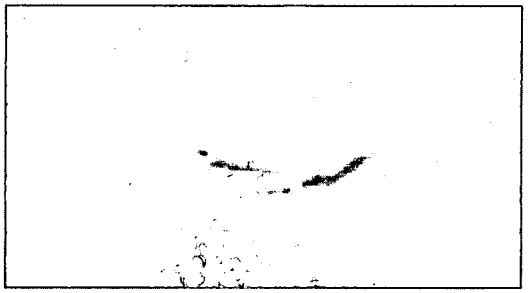
Figure 9E:
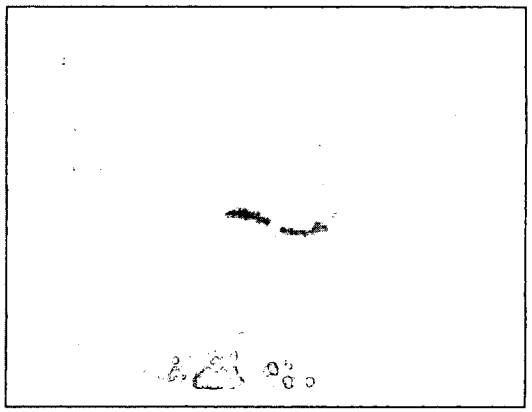

Nevertheless, during certain casting operations, aluminum alloys such as GM220 are susceptible to hot tearing where, referring next to FIG. 2, an example of a hot tear 110 in a component cast from GM220 is shown on at least one location on a cast product 100. As will be appreciated by those skilled in the art, various crack examination schemes are available, such as the dye penetrant inspection (DPI) or related methods. In general, hot tearing susceptibility (HTS) is expressed by the relation:

$$HTS=\Sigma(C_i \times L_i)$$

where C is the numerical value used to represent the degree of the crack severity in a test sample (such as a bar), and L is the numerical value corresponding to sample (bar) length. This latter factor takes into account the fact that the longer bars were less resistant to hot tearing than the shorter ones. For example, as shown with reference to FIGS. 9A through 9E, for the longest bar (near the bottom), L=1, and level of crack severity C is about 3 (shown with particularity in FIG. 9D). For the same casting, a shorter bar L=2 corresponds to the lighter crack where C is about 2 (shown with particularity in FIG. 9C), while an even shorter bar (shown with particularity in FIG. 9B) that corresponds to L=3 has a crack severity C of about 1. The HTS is the aggregate of these, specifically $1\times3+2\times2+3\times1=10$. The mold used for the present investigation has four pins (rods).

Figure 3:
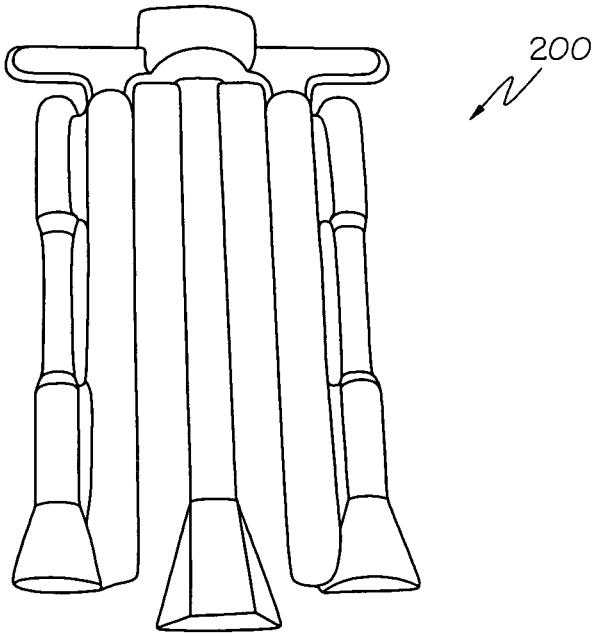
FIG. 3 shows a casting made from an aluminum alloy of the present invention, where a base aluminum alloy had 0.15 weight percent Zr added to it.
Figure 4:
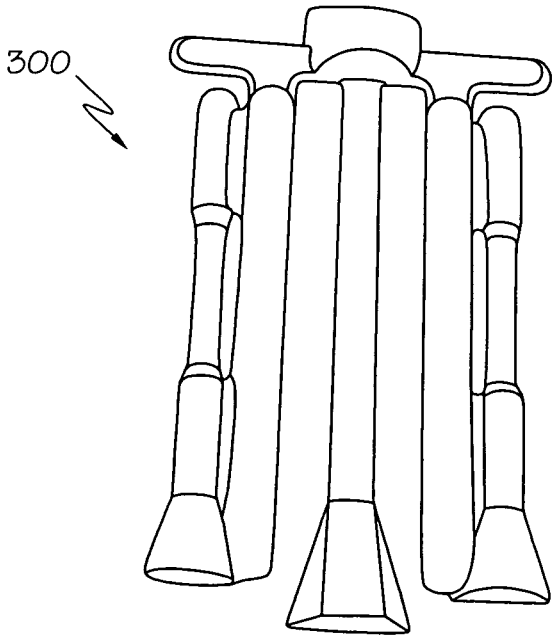
FIG. 4 shows a casting made from an aluminum alloy of the present invention, where a base aluminum alloy had 0.30 weight percent Zr added to it.

Referring next to FIGS. 3 and 4, examples of cast products 200 and 300, where the alloy GM220 had grain refining agents added to the mixture prior to being formed as a melt. It is believed that the presence of one or more of the Sc, Zr and $TiB_2$ in the melt improves the resistance of the alloy to hot tearing. It is further believed that nucleating agents, such as the metal carbides, nitrides and borides, by virtue of remaining substantially undissolved, facilitates the grain refining process. For example, $TiB_2$ can be used to initiate nucleation, thereby providing small grains in GM220 and related aluminum alloys. Examples of master alloys which provide $TiB_2$ nucleating agents include Al-3% Ti-1% B, Al-5% Ti-1B, Al-2.5% Ti-2.5% B and Al1-1.5% Ti-4% B.

This method of adding Zr, Sc or both before adding a Ti-containing grain refiner is an improvement over merely adding Ti, boron (B) or a combination of the two prior to pouring the casting. It was also found that adding just over one percent rare earth elements via mischmetal achieved similar results. Sc improves strength and weldability of the cast alloy by reducing the sensitivity to hot tear formation. Likewise, it increases the recrystallization temperature and improves the ability to control the grain structure. Zr acts as a recrystallization inhibitor, as does $TiB_2$.

To test the effects of the various grain refining agents being added to alloy GM220, the present inventors conducted a series of fifty castings. Table 1 shows the results of those castings, showing with particularity the number of hot tears that were produced.

TABLE 1

| Alloy | number of hot tears per fifty castings |
|---|---|
| GM220 | 30 |
| GM220 + 150 ppm Sr | 40 |
| GM220 + TiB | 18 |
| GM220 + Sr + TiB | 10 |
| GM220 + 1.0w/o Si | 0 |
| GM220 + 2.0 w/o Si | 0 |
| GM220 + 0.15w/o Sc | 0 |
| GM220 + TiB + 0.15w/o Sc | 0 |
| GM220 + TiB + Sc + Zr | 0 |
| GM220 + Sr + TiB + 0.7w/o Zr | 0 |
| GM220 + Sr + TiB + 0.7w/o Zr + 0.7w/o Ag | 0 |
| GM220 + 0.7w/o Zr | 0 |
| GM220 + TiB + 0.7w/o Zr | 0 |
| GM220 + TiB + 0.15w/o Zr | 0 |
| GM220 + TiB + 0.3w/o Zr | 0 |
| GM220 + TiB + 0.5w/o Zr | 0 |
| GM220 + 1.5w/o rare earth | 0 |
| GM220 + TiB + Sc + Zr + Ag | 0 |

As can be seen from the above table, the base alloy suffered thirty hot tears in fifty castings. Adding 150 ppm Sr as a eutectic modifier exacerbated the hot tear incidence to between forty and fifty. Grain refining with TiB resulted in lowering the hot tears to eighteen. Adding both Sr and TiB reduced it to ten hot tears. The addition of silicon to 2.0 and 3.0 percent by weight, in addition to improving castability, eliminated the hot tears, although at higher levels, the higher Si resulted in higher porosity (due to the presence of the eutectic Si phase that interferes with feeding during solidification) and lower strength. Adding Zr at 0.15 to 0.7 weight percent eliminated the hot tears, as did adding Sc. Furthermore, all combinations of Sr, TiB with one or both of Zr and Sc also resulted in the elimination of hot tears. Furthermore, adding mischmetal that produces 1.2 weight percent rare earths eliminated the hot tears.

Figure 5:
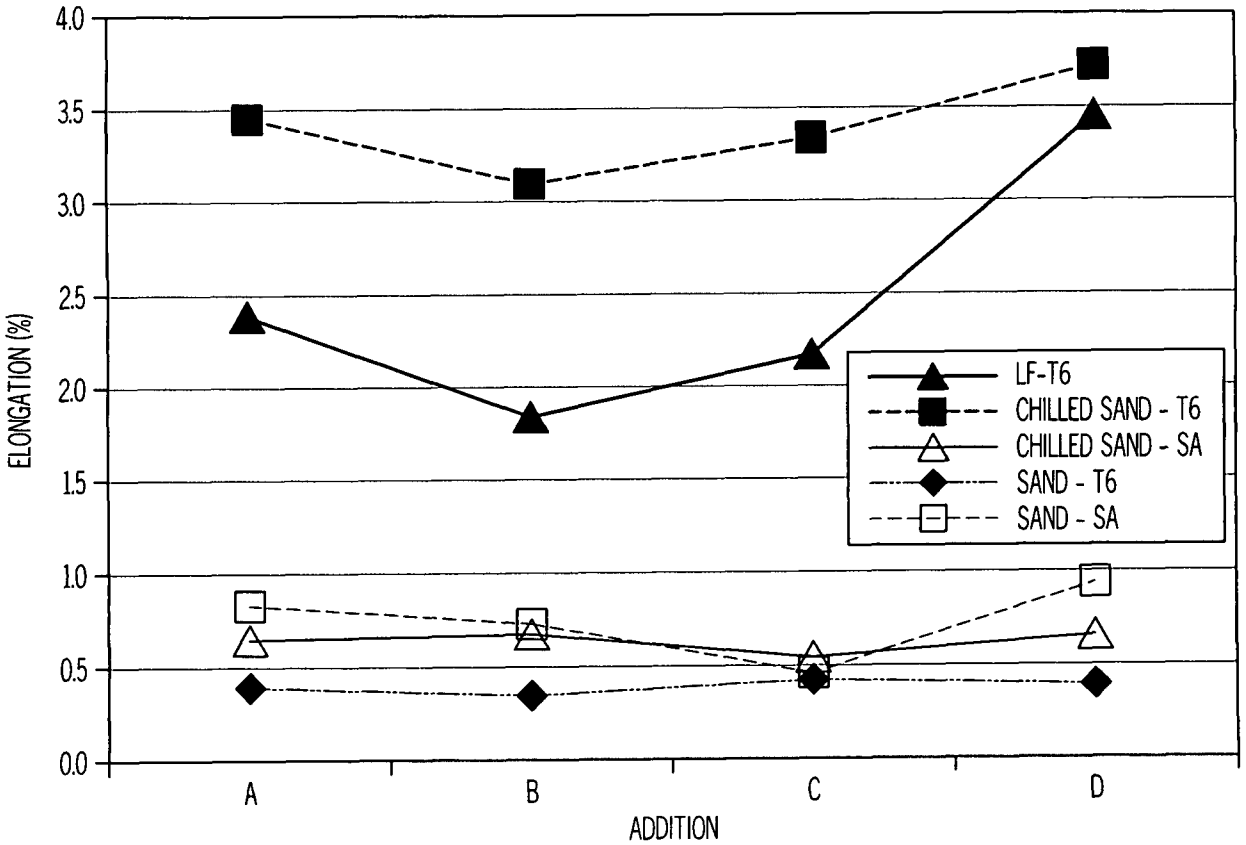
FIG. 5 shows the relative tensile strengths of an aluminum alloy with various grain refining agents and under various casting approaches.
Figure 6:
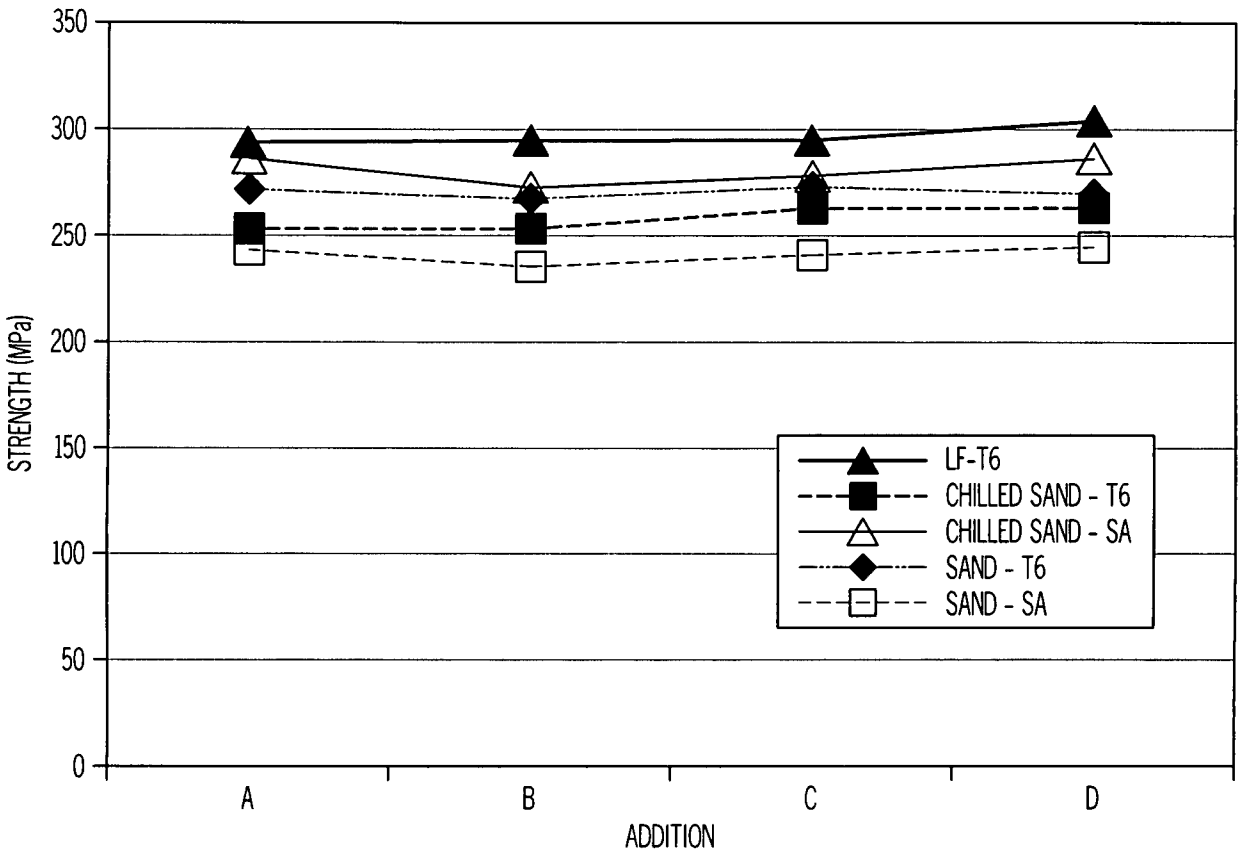
FIG. 6 shows the relative yield strengths of an aluminum alloy with various grain refining agents and under various casting approaches.
Figure 7:
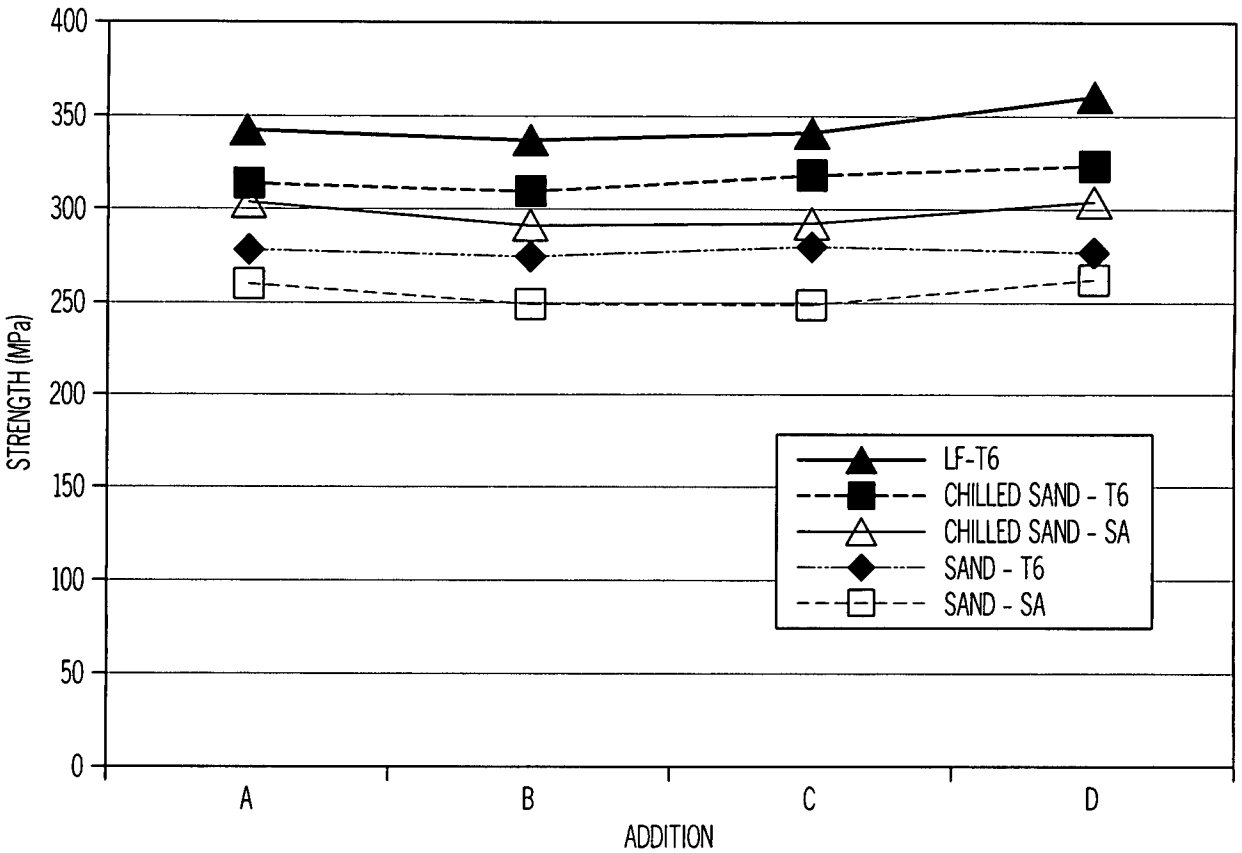
FIG. 7 shows the relative tensile elongation of an aluminum alloy with various grain refining agents and under various casting approaches.

Referring next to FIGS. 5 through 7, the tensile strength properties of the base alloy GM220 are shown for various casting processes and heat treatments, as well as for different additives. In each of the figures, the abscissa designation A represents the base (GM220) alloy, while the abscissa designation B represents the base alloy plus an addition of 0.01 weight percent TiB, the abscissa designation C represents the abscissa designation B plus 0.15 weight percent Zr and the abscissa designation D represents the abscissa designation B plus 0.25 weight percent Zr. There are two separate casting processes shown, the first being lost foam (LF) and the second being sand cast (SAND). Within the sand casting process, there are two separate variants, the first incorporating chilled regions and the second incorporating unchilled regions. In the lost foam process, the component made was a cylinder head, while that of the sand casting was for bars, where a small chill was further employed in the drag of half of the bars. The castings were heat treated to one of two conditions, the first being T6 conditions (a solution at 920° F. for eight hours followed by a hot water quench age at 360° F. for eight hours), the second being SA conditions (a solution at 920° F. for eight hours followed by a hot water quench age at 480° F. for one hour, then 360° F. for six hours); the latter of these heat treatments is a two-step, sequential age process. Significantly, none of the above-mentioned additives adversely impacted the tensile properties of the alloy, and as such would be suitable for use in making cylinder heads and related cast components.

The present inventors have discovered that various ranges could be employed in the grain refining agents added to the base alloy. For example, Sc can be added in a broad range of 0 to about 1 weight percent, with a more particular range of 0.1 to 0.75 weight percent and an even more particular range of 0.2 to 0.5 weight percent. Likewise, Zr can be added in a broad range of 0 to about 1 weight percent, with a more particular range of 0.1 to 0.75 weight percent and an even more particular range of 0.15 to 0.25 weight percent. Ti can be added in a broad range of 0 to 0.25 weight percent, with a more particular range of 0.02 to 0.15 weight percent and an even more particular range of 0.04 to 0.08 weight percent. B can be added in a broad range of between 0 and 100 ppm, in a medium range of between 5 and 50 ppm, and in a narrow range of between 5 and 20 ppm. In addition, rare earth elements can be added in a broad range of 0 to about 3 weight percent, with a more particular range of 1 to 2.5 weight percent and an even more particular range of 1.25 to 1.75 weight percent.

The addition of Zr in amounts at least up to 0.7 weight percent is not harmful to tensile properties; in fact, a low amount of Zr improves tensile properties over both no Zr and 0.7 weight percent Zr, implying an optimal range for tensile properties. Considering only the impact on hot tears, a certain minimum amount of Zr is required; such minimum will depend on die temperature and solidification rate as well as part geometry. The inventors believe that zirconium oxide (ZrO) dispersoids could improve the high temperature strength retention of GM220 alloy. Likewise, in chilled sections, the addition of Zr plus TiB improves the mechanical properties of the cast product.

The T6 (i.e., fully aged) tensile strength is higher than the chilled sand SA cast product, whereas elongation is higher for SA. Lost foam properties are somewhat lower than sand cast for both strength and elongation.

It will be appreciated by those skilled in the art that the Ti present in an alloy according to the present invention may be present in both the dissolved and undissolved form. Generally, maintaining relatively low levels of dissolved Ti contributes to the desirable smaller grain size and concomitant reduction in hot cracking. The smallest grain sizes are generally produced by the lower Ti levels. By way of example, an important commercially-available grain refiner is the master alloy discussed above that has the composition Al-3% Ti-1% B, which contains both soluble Ti and numerous microscopic particles of $TiB_2$ that are suspended in the master alloy, and released into the melt when the master alloy is added to a bath of liquid aluminum. The particles are typically about one micron in diameter, and are therefore easily suspended in the molten metal. They are also insoluble in molten aluminum at normal casting temperatures. The amount of addition of insoluble and soluble titanium present in boride particles may be both varied and calculated. Furthermore, by allowing the melt to sit for an extended period of time (for example, two hours), all of the Ti added will go into solution, at which time no additional grain refinement would be produced.

A constant addition of a grain nucleating agent comprised of Ti and B can be accomplished by adding a quantity of commercial Al-3% Ti-1% B (3 wt. % Ti, 1 wt. % B, remainder aluminum) master alloy to the melts, where at least a portion of the Ti is present in the form of insoluble borides, with the remainder in dissolvable form.

In addition to the grain refining agents discussed above, processing conditions can be varied to improve hot tear resistance through smaller small grain size. For example, solidification times can be varied, where the casting method may influence the grain size. For example, the slower cooling rate of sand casting tends to produce larger grains than that of permanent mold castings.

Figure 8A:
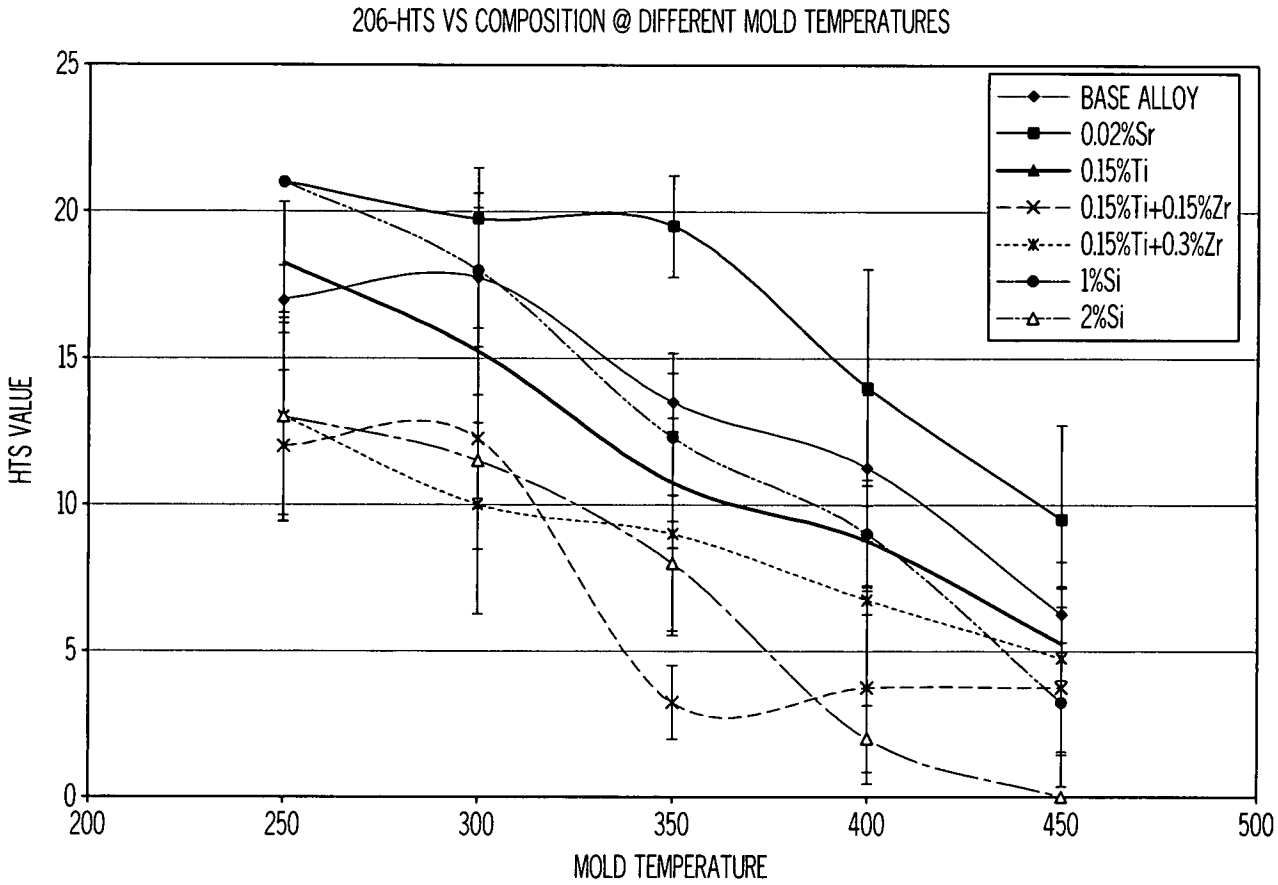
FIG. 8A shows the effect of mold temperature on one alloy made in accordance with the present invention.
Figure 8B:
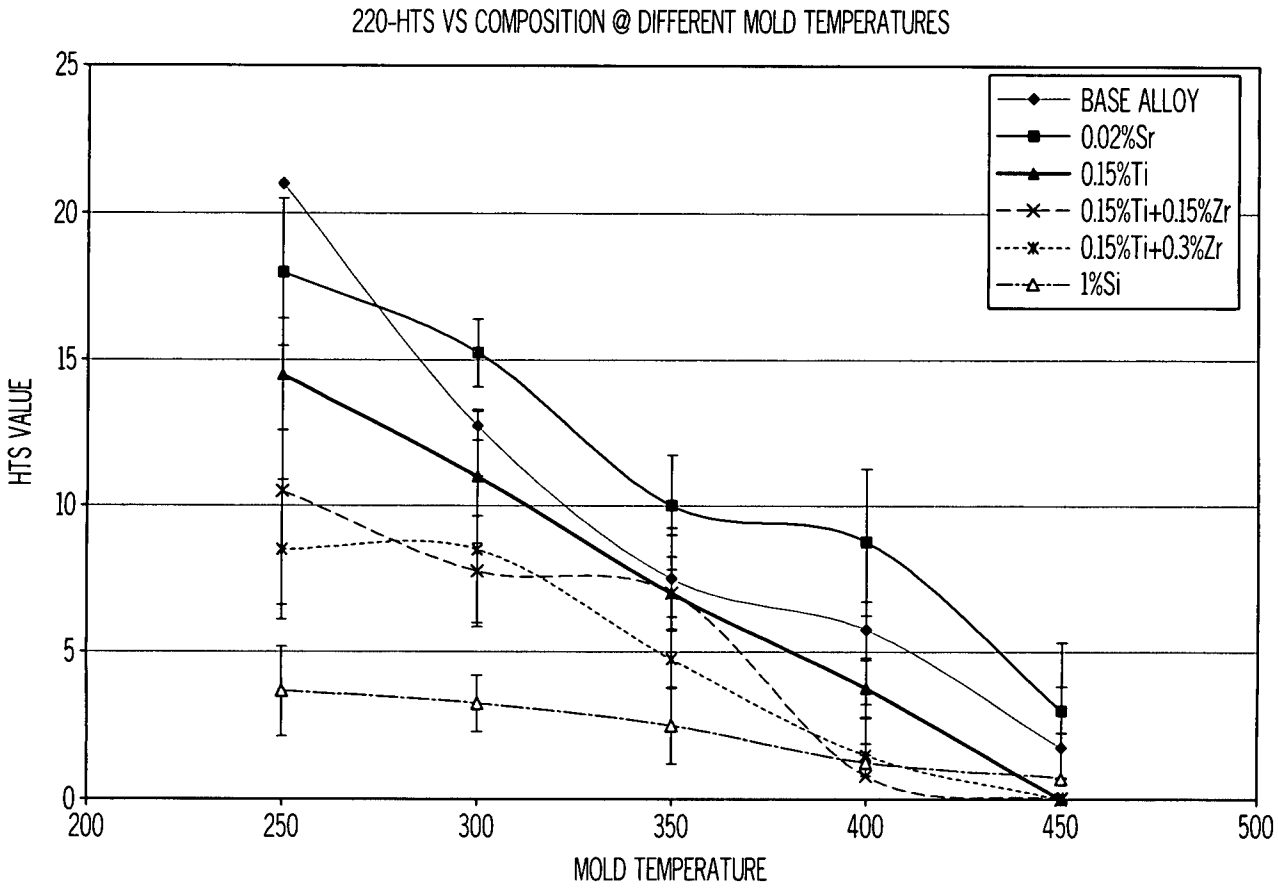
FIG. 8B shows the effect of mold temperature on another alloy made in accordance with the present invention.

Referring next to FIGS. 8A and 8B, HTS properties of two representative alloys as a function of mold temperature are shown. FIG. 8B shows the HTS properties of GM220 discussed above, while FIG. 8A shows the HTS properties of an alloy (Alloy 206) that the inventors have shown to respond well to the treatment approaches discussed herein. A comparison of the notional compositions of the two alloys is shown in Table 2, where elements such as Ni, Sn and Ti are examples of tolerable impurities, while other components, such as Sr (which may also be a tolerable impurity in certain quantities, for example, up to about 0.05 weight percent), are included in the "Others" column to designate elements that are not known to appreciably alter the properties of the alloy.

TABLE 2

| Alloy | Si | Fe | Cu | Mn | Mg | Ni | Zn | Sn | Ti | Ca | P | Others |
|---|---|---|---|---|---|---|---|---|---|---|---|---|
| GM220 | 1.1 | 0.4 | 1.9 | 0.5 | 0.3 | .05 | 0.5 | .05 | .02 | .04 | .04 | .05 |
| | 1.3 | 0.5 | 2.5 | 0.75 | 0.5 | | | | .20 | | | |
| 206 | 0.1 | 0.1 | 4.2 | 0.2 | 0.2 | .03 | 0.5 | .05 | .15 | .05 | .05 | .05 |
| | | | 5.0 | 0.5 | 0.35 | | | | .25 | | | |

The alloy depicted in FIG. 8A, which is a commercially-available aluminum alloy known as Alloy 206, is used for very high-strength applications. It is more difficult to cast than GM220, especially in metal mold casting processes. Grain-refining prior to casting improves resistance to hot tearing, while mold thermal management and casting design play a strong role as well. The grain refining treatment discussed herein has been shown to greatly improve the hot cracking tendency of Alloy 206 to the point where it can be cast almost as free of hot tears as that of GM220. The high Cu content results in a longer heat treatment process, while the solutionizing stage must be started at lower temperature and then increased once the lowest melting-point phases are dissolved. Review of the two figures shows that additional trends are also in evidence. For example, Sr increases the HTS of both alloys, while the addition of Ti alone is not sufficient in and of itself to provide a robust solution.

A typical Alloy 206 heat treatment may proceed as follows. The solutionizing stage is 480 degrees Celsius for one hour, followed by a ramp up to 495 degrees Celsius over a half an hour, after which it is held at 495 degrees Celsius for two hours, followed by a ramp up to 528 degrees Celsius over a half an hour, then holding at 528 degrees Celsius for ten hours. Next, a quenching stage followed by an aging stage at 200 degrees Celsius for four hours. By comparison, GM220 can be heat treated with more conventional T6 process, where (for example) the solutionizing stage takes place at 495 degrees Celsius for six hours, followed by a quench and subsequent aging at 190 degrees Celsius for six hours.

While certain representative embodiments and details have been shown for purposes of illustrating the invention, it will be apparent to those skilled in the art that various changes may be made without departing from the scope of the invention, which is defined in the appended claims.

What is claimed is:

1. A method of increasing hot tear resistance in a cast aluminum alloy, said method comprising:

providing a mixture consisting essentially of up to about 0.5 weight percent zinc, between about 0.2 and about 0.5 weight percent magnesium, between about 0.1 and about 0.5 weight percent iron, between about 0.2 and about 0.75 weight percent manganese where the ratio of manganese to iron is between about 1.25 and about 1.45, about 1.0 to about 2.0 weight percent silicon, between about 1.9 and about 5.0 weight percent copper, up to 0.05 weight percent calcium, up to 0.05 weight percent phosphorous, the balance substantially aluminum and other alloying ingredients, wherein said other alloying ingredients comprise up to 0.05 weight percent of said mixture;

initially refining grain size comprising dissolving in a melt of said mixture one or more first grain refining agents selected from scandium and zirconium;

further refining grain size comprising subsequently adding to the melt just prior to casting one or more second grain refining agents selected from metal carbides, metal aluminides, metal borides and at least one rare earth element;

and casting said melt in a permanent mold casting such that at least a portion of said one or more second grain refining agents is substantially undissolved in said mixture; and solidifying said melt in said permanent mold casting to provide a substantially hot crack-free cast aluminum alloy product.

2. The method of claim 1, wherein said initial refining of grain size comprises adding scandium in an amount of up to 0.15 weight percent of said mixture.

3. The method of claim 2, wherein at least one of said second grain refining agents is titanium diboride.

4. The method of claim 1, wherein said second grain refining agents comprises titanium diboride and said first grain refining agents comprises zirconium in an amount of up to 0.7 weight percent of said mixture.

5. The method of claim 4, wherein said second grain refining agents further comprises silver in an amount of up to 0.7 weight percent of said mixture.

6. The method of claim 1, wherein said initial refining of grain size comprises adding zirconium in an amount of up to 0.7 weight percent of said mixture.

7. The method of claim 1, wherein said initial refining of grain size comprises adding zirconium in an amount of between about 0.15 to about 0.5 weight percent of said mixture.

8. The method of claim 1, wherein said further refining grain size comprises adding up to approximately 1.5 weight percent of at least one rare earth element.

9. The method of claim 8, wherein said at least one rare earth element comes from adding mischmetal to said mixture.

10. The method of claim 1, wherein said provided mixture has between about 1.1 and about 1.3 weight percent silicon, between about 0.4 and about 0.5 percent iron, between about 1.9 and 2.5 weight percent copper, between about 0.5 and about 0.75 weight percent manganese, between about 0.3 and about 0.5 weight percent magnesium, up to about 0.04 weight percent calcium and up to about 0.04 weight percent phosphorous.

11. The method of claim 10, wherein said mixture has up to about 0.05 weight percent nickel, up to about 0.05 weight percent tin, and between about 0.02 and about 0.2 weight percent titanium.

12. The method of claim 1, wherein said further refining of grain size comprises adding a titanium-containing compound that produces between 0.02 to 0.2 weight percent of titanium in said mixture.

13. The method of claim 1, wherein said initial refining of grain size comprises adding scandium and zirconium.

14. The method of claim 12, wherein said further refining grain size comprises adding titanium diboride and silver.

15. A method of improving hot tear resistance in an aluminum alloy, said method comprising:

providing a mixture consisting essentially of about 1.0 to about 2.0 weight percent silicon, between about 1.9 and about 5.0 weight percent copper, between about 0.1 and about 0.5 weight percent iron, between about 0.2 and about 0.75 weight percent manganese, up to about 0.5 weight percent zinc, between about 0.2 and about 0.5 weight percent magnesium, up to 0.05 weight percent calcium, up to 0.05 weight percent phosphorous, and balance substantially aluminum and other alloying ingredients, wherein said other alloying ingredients comprise up to 0.05 weight percent of said mixture;

is solving in a melt of said mixture at least one grain refining agent selected from scandium, zirconium and at least one rare earth element such that said additions provide an initial refinement of grain size;

subsequently adding titanium boride to said melt just prior to casting such that further refinement of grain size is provided and upon casting said melt in a permanent mold casting, at least a portion of said titanium boride is substantially undissolved; and solidifying said melt in said permanent mold casting to provide a substantially hot crack-free cast aluminum alloy product.

* * * * *